United States Patent [19]

Itoigawa

[11] Patent Number: 4,751,552

[45] Date of Patent: Jun. 14, 1988

[54] IMAGE FORMING APPARATUS

[75] Inventor: Masakatsu Itoigawa, Nara, Japan

[73] Assignee: Sharp Kabushiki Kaisha, Osaka, Japan

[21] Appl. No.: 48,767

[22] Filed: May 12, 1987

[30] Foreign Application Priority Data

May 16, 1986 [JP] Japan ..... 61-74209

[51] Int. Cl.[4] ..... G03G 15/00

[52] U.S. Cl. ..... 355/3 SH; 355/3 R; 355/14 SH

[58] Field of Search ..... 355/3 R, 3 SH, 3 DR, 355/3 BE, 16

[56] References Cited

U.S. PATENT DOCUMENTS 4,500,195 2/1985 Hosono ..... 355/3 R
4,609,276 9/1986 Mitzutani ..... 355/3 R
4,671,644 6/1987 Sumida et al. ..... 355/3 SH X
4,681,422 7/1987 Oba et al. ..... 355/3 R
4,685,792 8/1987 Iseki et al. ..... 355/3 SH

*Primary Examiner*—A. C. Prescott
*Attorney, Agent, or Firm*—Flehr, Hohbach, Test, Albritton & Herbert

[57] ABSTRACT

An image forming apparatus has an upper unit which can be separated from a lower unit. The lower unit contains a paper cassette and a sheet discharged from the cassette is turned over by a paper turning member having a curved surface and is introduced into a transporting path along the boundary of the upper unit and the lower unit. The paper turning member is separable into an upper piece attached to the upper unit and a lower piece attached to the lower unit such that the operator has only to open the upper unit, when there is a jamming of paper, and can remove the jammed paper either from the paper transporting route or at the position of the paper turning member.

4 Claims, 5 Drawing Sheets

IMAGE FORMING APPARATUS

BACKGROUND OF THE INVENTION

This invention relates to an image forming apparatus of the type which is separable into upper and lower units and more particularly to such an image forming apparatus having a paper cassette in the lower unit such that each sheet discharged from the cassette changes the direction of its motion and is transported then to a processing section in the upper unit for processing.

There are image forming apparatus which are separable into upper and lower units, the lower unit containing a paper cassette and a paper turning member for turning a sheet of paper discharged from the cassette to change the direction of its motion, the upper unit containing a processing section for image formation, and a paper transporting route being formed along the boundary between the upper and lower units. The upper and lower units of such an apparatus are separable and the paper transporting route can be opened up such that when there is a jamming in the paper transporting route, the jammed paper can be easily removed. If a jamming takes place in the neighborhood of the paper turning member, however, the jammed paper cannot be removed merely by opening the upper unit. For this reason, conventional image forming apparatus of this type were structured such that a paper turning member near the paper cassette can also be opened up.

In FIGS. 5A and 5B, which show a conventional image forming apparatus 1 of the type separable into an upper unit 1*a* and a lower unit 1*b* as described above, a paper cassette 2 is removably inserted into the lower unit 1*b* such that sheets of paper are discharged from its right-hand end. On the right-hand side of the paper cassette 2 and adjacent thereto is a paper turning member 3 having a curved (concave) guiding surface 3*c*. The upper unit 1*a* is rotatably supported by the lower unit 1*b* around an axis P above the paper turning member 3 such that the apparatus can be opened by separating the upper and lower units through an opening for ejecting the processed paper. The paper turning member 3, in turn, is rotatably supported by the lower unit 1*b* around another axis Q at the lower part thereof such that the paper turning section can be opened up from above. A sheet discharged from the paper cassette 2 is turned over by this paper turning member 3 and transported to the processing section inside the upper unit 1*a* through a transporting route 4 formed along the boundary between the lower unit 1*a* and the upper unit 1*b*.

If a sheet thus being transported from the paper cassette 2 becomes jammed, the operator opens the upper unit 1*a* in the upward direction or the paper turning member 3 in the downward direction. Although FIG. 5*b* shows both the upper unit 1*a* and the paper turning member 3 in the opened conditions, the operator has only to open the upper unit 1*a* if the jamming is on the paper transporting route 4. Likewise, the operator has only to open the paper turning member 3 if the jamming is near its position. With a conventional apparatus structured as shown in FIGS. 5A and 5B, however, the operator cannot immediately ascertain whether the jamming has occurred on the paper transporting route 4 or near the paper turning member 3. In other words, it is frequently the case that the operator must open up both the upper unit 1 and the paper turning member 3. Although attempts have been made to provide means for informing the position of a jam to the operator, sensors for detecting the position of a jam, display means for displaying this information and control means for controlling these additional devices add to the overall cost of the apparatus.

A conventional image forming apparatus of another type is illustrated in FIGS. 6A and 6B wherein components which are equivalent or similar to those shown in FIGS. 5A and 5B are indicated by the same numerals. This apparatus is characterized as having the paper turning member 3 unistructurally formed on the paper-discharging end of the paper cassette 2 and the upper unit 1*a* rotatably supported by the lower unit 1*b* around an axis near the opening through which processed paper is ejected. With an apparatus of this structure, the curved guiding surface 3*c* is opened when the paper cassette 2 is pulled forward together with the paper turning member 3. Neither with this apparatus, however, can the operator ascertain immediately whether the jamming is on the paper transporting route 4 or near the paper turning member 3 unless a detector, etc. are provided at an increased cost.

SUMMARY OF THE INVENTION

It is therefore an object of the present invention to provide an image forming apparatus from which a jammed sheet of paper can be removed merely by opening its upper unit.

The above and other objects of the present invention are achieved by providing an image forming apparatus of an improved design. The apparatus is comprised of a lower unit having a paper cassette and an upper unit which is rotatably supported by the lower unit around an axis. A paper turning member with a curved surface for turning and changing the direction of motion of the paper discharged from the cassette is divided into two parts, each affixed to or made a part of the upper or lower unit such that, when the upper unit is opened, not only the paper transporting route formed along the boundary between the upper and lower units but also the curved surface of the paper turning member becomes exposed.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE INVENTION

Figure 1A:
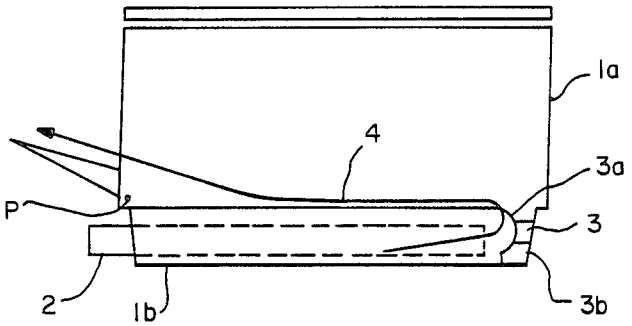
FIG. 1A and 1B are schematic horizontal views of a copier embodying the present invention when it is closed and opened, respectively.
Figure 1B:
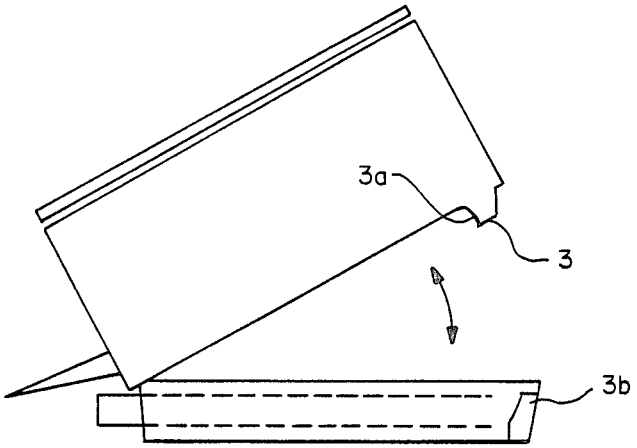
Figure 5A:
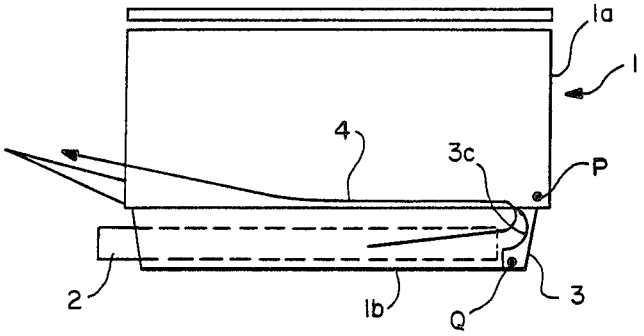
(PRIOR ART) FIG.-5A
FIGS. 5A and 5B are schematic horizontal views of a conventional image forming apparatus when it is closed and opened, respectively.
Figure 5B:
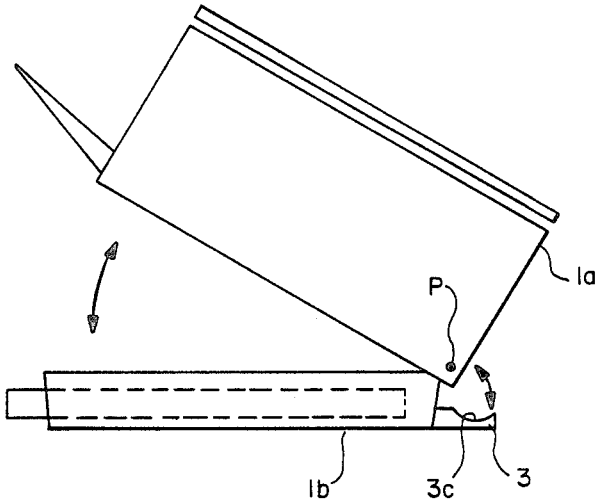
FIG.-5B (PRIOR ART)
Figure 6A:
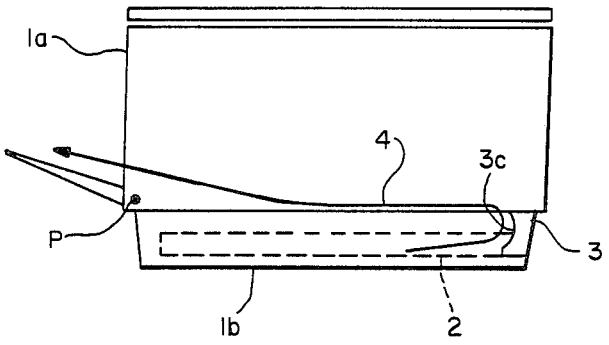
(PRIOR ART) FIG.—6A
FIGS. 6A and 6B are schematic horizontal views of another conventional image forming apparatus when it is closed and opened, respectively.
Figure 6B:
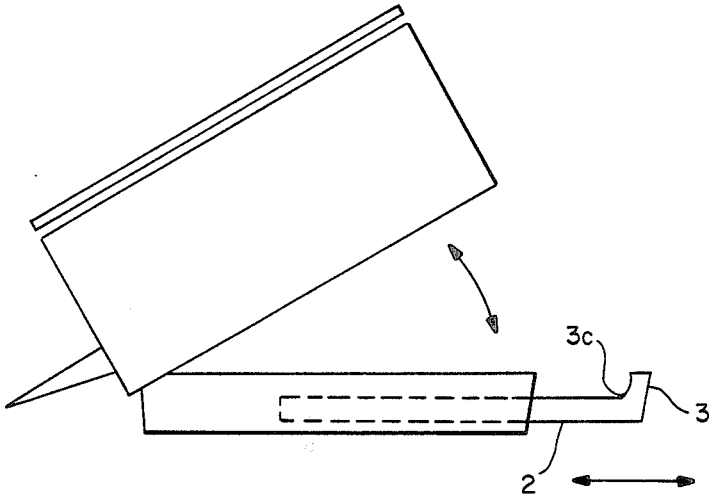
(PRIOR ART) FIG.—6B

An image forming apparatus of the present invention shown in FIGS. 1A and 1B is different from the conventional apparatus shown in FIGS. 5A and 5B firstly in that the upper unit 1*a* is rotatably supported by the lower unit 1*b* around an axis P which is near the opening through which processed paper is ejected such that the paper cassette 2 opens upward at its paper discharging end, and secondly in that the paper turning member 3 for changing the direction of motion of the discharged sheet of paper is divided into an upper piece 3*a* and a lower piece 3*b* which are respectively made a part of the upper unit 1*a* and the lower unit 1*b*. It is also different from the conventional apparatus shown in FIGS. 6A and 6B firstly in that the paper cassette 2 is made removable in the direction of the aforementioned paper ejection opening and secondly in that the paper turning member 3 is divided as mentioned above. FIG. 1A shows the apparatus when the upper unit 1*a* is closed with respect to the lower unit 1*b* and FIG. 1B shows it when the upper unit 1*a* is opened.

When the upper unit 1*a* is opened, the upper piece 3*a* moves upward with the upper unit 1*a* as shown in FIG. 1B and the curved surface of the paper turning member 3 becomes exposed at the same time. In other words, the operator has only to pull up the upper unit 1*a* to expose not only the paper transporting route 4 along the boundary of the upper unit 1*a* and the lower unit 1*b* but also the curved surface of the paper turning member 3 and to thereby remove a jammed sheet of paper. In summary, an image forming apparatus of the present invention enables the operator to remove a jammed sheet of paper simply by opening the upper unit. The operator is no longer required to open another part additionally, nor is any sensor or the like required to inform the operator where the jamming has occurred. An additional advantage of the present invention is that the upper piece 3*a* and the lower piece 3*b* may be made to engage with respect to each other such that the freedom of motion around the axis P between the upper and lower units and dimensional errors in components can be compensated. In other words, the upper and lower units can be made sure to close securely with respect to each other, thereby preventing the occurrence of jamming.

Figure 2:
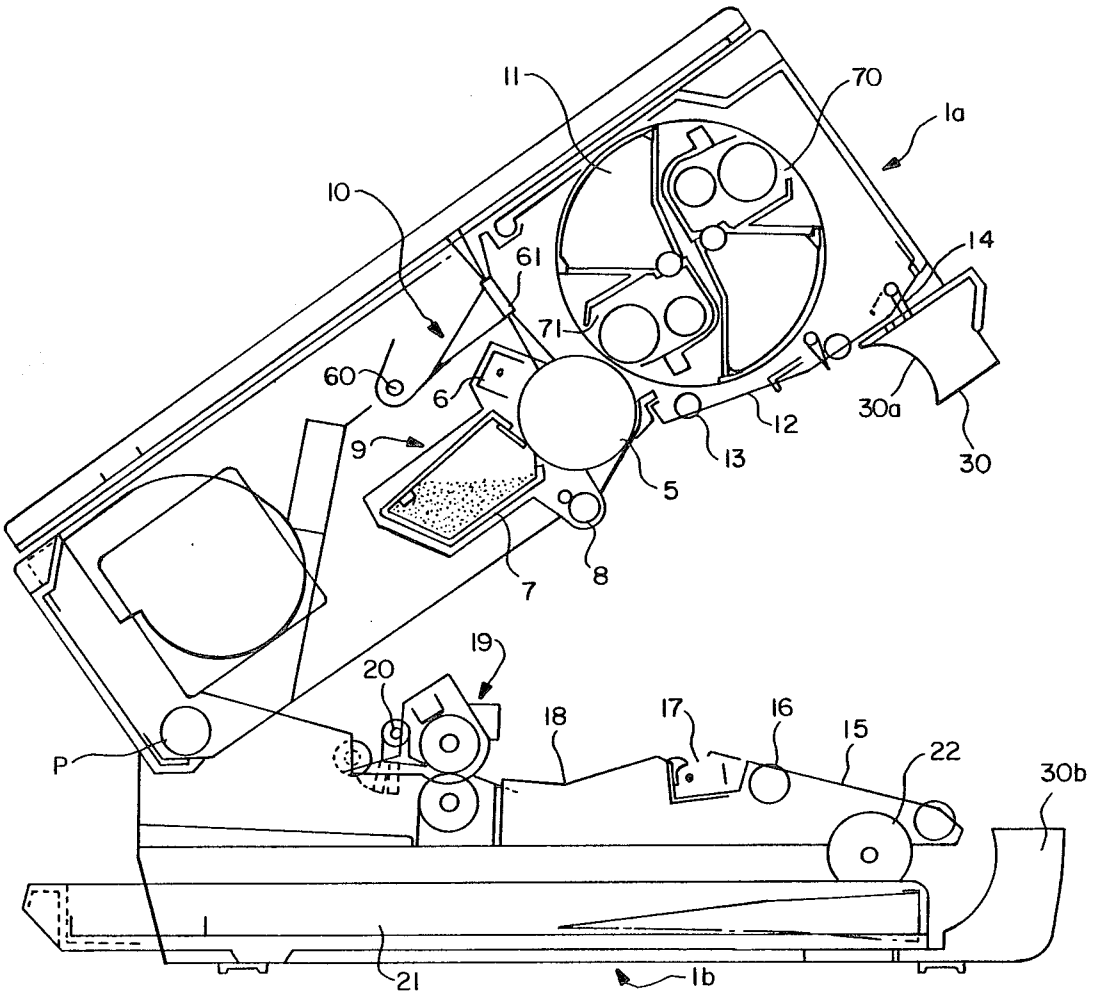
FIG. 2 is a schematic sectional view of the copier of FIGS. 1A and 1B when its upper unit is opened with respect to its lower unit.
Figure 3:
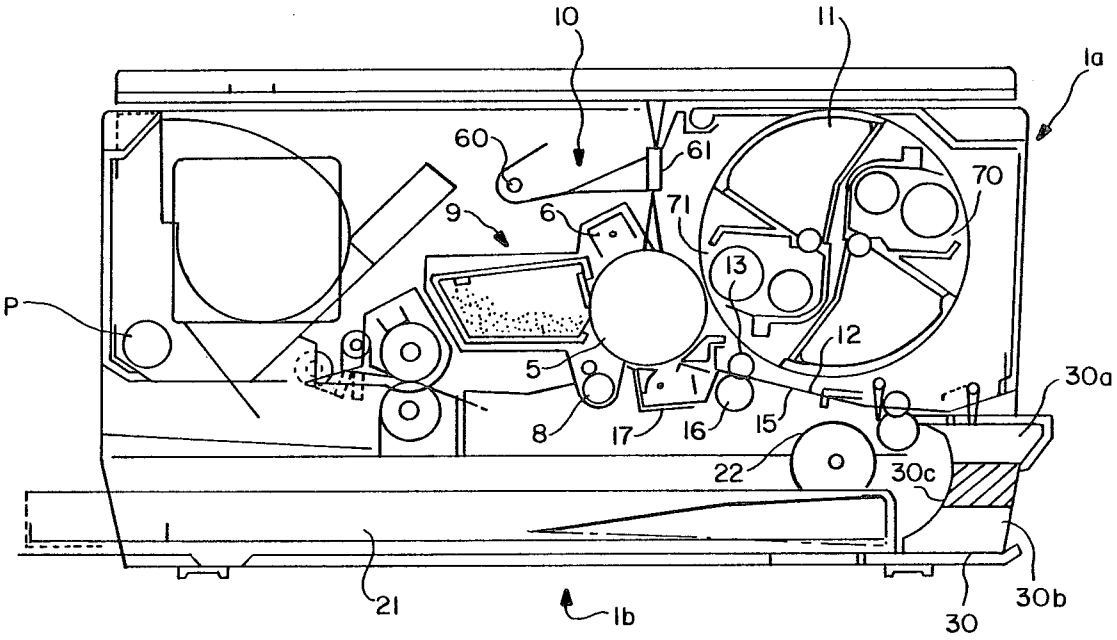
FIG. 3 is a schematic sectional view of the copier of FIG. 2 when its upper unit is closed with respect to its lower unit.
Figure 4:
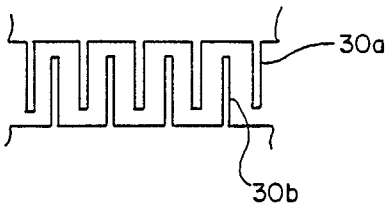
FIG. 4 shows the upper and lower pieces of the paper turning member of FIGS. 2 and 3 in mutually engaged relationship.

A copier embodying the present invention is illustrated in FIG. 2 which shows it when it is open, FIG. 3 which shows it when it is closed and FIG. 4 which shows the engagement of the upper and lower pieces of the paper turning member. As explained above, the upper unit 1*a* is rotatably supported by the lower unit 1*b* around the axis P. The upper unit 1*a* contains a unistructural replaceable processing unit 9 which includes a photosensitive drum 5, a charger 6, a cleaner unit 7 and a separation roller 8. If it becomes necessary to exchange the cleaner unit 7, for example, the entire processing unit 9 must be exchanged according to this embodiment. Above the processing unit 9 which is detachably affixed to the upper unit 1*a*, there is an optical unit 10 comprised of a light source 60 and a converging light transmitting means 61. A developing section 70 is disposed on the right-hand side of the photosensitive drum 5. In front of the photosensitive drum 5 is a paper transporting guide 12 with a timing roller 13 thereon. A detector switch 14 for manually supplied copy paper is attached at the right-hand end of the upper unit 1*a*.

Protruding downward from the right-hand end of the upper unit 1*a* is the upper piece 30*a* of a paper turning member 30. The internal side surface of the turning paper member 30 forms a curved surface 30*c*. A copy paper sheet discharged from a paper cassette is turned around by this curved surface 30*c* and transported in the direction of the processing unit 9.

On the upper right-hand side of the lower unit 1*b* is another paper transporting guide 15. On this paper guide 15 is another timing roller 16 opposite to the aforementioned timing roller 13 on the side of the upper unit 1*a*. To the left of the timing roller 16 is a transfer unit 17 which faces the photosensitive drum 5 when the upper unit 1*a* is closed with respect to the lower unit 1*b*. Further to the left of the transfer unit 17 is still another paper transporting guide 18 for transporting a copy paper sheet. Still further to the left of this paper transporting guide 18 are fixing rollers 19 and another detector switch 20 for detecting a copy paper sheet discharged from the fixing rollers 19. At the bottom section of the lower unit 1*b* is a paper cassette 21 detachably inserted thereinto. A paper feed roller 22 is provided at the right-hand edge, or the paper-discharging end of the paper cassette 21.

When the upper unit 1a of the copier thus structured is closed with respect to the lower unit 1*b*, the curved inner surface 30*c* of the paper turning member 30 is in a face-to-face relationship with and directly opposite to the paper feed roller 22 as shown in FIG. 3. When a sheet of copy paper is taken out of the paper cassette 21 by the operation of the paper feed roller 22, therefore, it is turned over by the curved surface 30*c* of the paper turning member 30 and is transported to the image transfer position of the photosensitive drum 5 by means of the paper transporting guides 12 and 15 and the timing rollers 13 and 16. If a sheet being thus transported becomes jammed, the operator has only to lift the upper unit 1a to an open position as shown in FIG. 2, thereby exposing not only the paper transporting guides 12, 15 and 18 but also the curved surface 30*c* of the paper turning member 30 such that the jammed sheet can be easily spotted and removed by the operator.

According to one embodiment of the present invention, the upper and lower pieces 30*a* and 30*b* of the paper turning member 30 are formed in mutually engageable comb-like shapes as shown in FIG. 4. With the pieces 30*a* and 30*b* thus structured, the upper unit 1*a* can be closed securely with respect to the lower unit 1*b* even if there are slight dimensional errors in the copier components.

The foregoing description of a preferred embodiment of the invention has been presented for purposes of illustration and description. It is not intended to be exhaustive or to limit the invention to the precise form disclosed, and obviously many modifications and variations are possible in light of the above teaching. Such modifications and variations that may be apparent to a person skilled in the art are intended to be included within the scope of this invention.

What is claimed is:

1. In an image forming apparatus comprising a lower unit, an upper unit which is supported by said lower unit rotatably around an axis, and defines a boundary with said lower unit, a paper cassette removably attached to said lower unit and having a paper discharging end, and a paper turning member disposed near said paper discharging end of said paper cassette and serving to turn a discharged sheet from said paper discharging end and to direct said sheet into a paper transporting route formed at said boundary between said lower unit and said upper unit, the improvement wherein said axis is so positioned that said upper unit opens above said paper discharging end of said paper cassette, and said paper turning member is divided into an upper piece attached to said upper unit and a lower piece which is attached to said lower unit.

2. The image forming apparatus of claim 1 wherein said upper piece and said lower piece are engaged with respect to each other when said upper unit is closed with respect to said lower unit.

3. The image forming apparatus of claim 1 wherein said upper piece is formed unistructurally as a part of said upper unit.

4. The image forming apparatus of claim 1 wherein said upper piece and said lower piece have comb-like mutually engageable surfaces.

* * * * *